US008657894B2

(12) United States Patent
Pearce et al.

(10) Patent No.: US 8,657,894 B2
(45) Date of Patent: Feb. 25, 2014

(54) USE OF RESONANT MIXING TO PRODUCE IMPREGNATED BITS

(75) Inventors: Cody A. Pearce, Midvale, UT (US); Michael Rupp, Murray, UT (US); Christian M. Lambert, Draper, UT (US); Nathan Carlson, Salt Lake City, UT (US); Joseph Moody, Draper, UT (US)

(73) Assignee: Longyear TM, Inc., South Jordan, UT (US)

( * ) Notice: Subject to any disclaimer, the term of this patent is extended or adjusted under 35 U.S.C. 154(b) by 80 days.

(21) Appl. No.: 13/276,080

(22) Filed: Oct. 18, 2011

(65) Prior Publication Data

US 2012/0260581 A1 Oct. 18, 2012

Related U.S. Application Data

(60) Provisional application No. 61/476,027, filed on Apr. 15, 2011.

(51) Int. Cl.

| | |
|---|---|
| ***B24D 3/02*** | (2006.01) |
| ***C09C 1/68*** | (2006.01) |
| ***C09K 3/14*** | (2006.01) |

(52) U.S. Cl.

USPC ..... 51/309; 51/307; 366/9; 366/108

(58) Field of Classification Search

None

See application file for complete search history.

(56) References Cited

U.S. PATENT DOCUMENTS

| | | | |
|---|---|---|---|
| 1,041,568 | A | 10/1912 | Bade |
| 1,572,386 | A | 2/1926 | Gates |
| 1,939,991 | A | 12/1933 | Krusell |
| 2,147,843 | A | 2/1939 | Jamar et al. |
| 2,326,908 | A | 8/1943 | Williams, Jr. |
| 2,371,488 | A | 3/1945 | Williams, Jr. |
| 2,495,400 | A | 1/1950 | Williams, Jr. |
| 2,552,485 | A | 5/1951 | Howard et al. |
| 2,811,960 | A | 11/1957 | Fessel |
| 2,969,122 | A | 1/1961 | Steffes |
| 3,215,215 | A | 11/1965 | Kellner |
| RE26,669 | E | 9/1969 | Henderson |
| 3,495,359 | A | 2/1970 | Smith et al. |
| 3,537,538 | A | 11/1970 | Generoux |
| 3,972,161 | A | 8/1976 | Zoiss |
| 4,093,449 | A | 6/1978 | Svensson et al. |
| 4,128,136 | A | 12/1978 | Generoux |

(Continued)

FOREIGN PATENT DOCUMENTS

| | | | |
|---|---|---|---|
| EP | 0086086 | A2 | 8/1983 |
| EP | 0311422 | A1 | 4/1989 |

(Continued)

OTHER PUBLICATIONS

Office Action dated Sep. 9, 2008 from U.S. Appl. No. 11/948,185, filed Nov. 30, 2007 (8 pages).

Office Action dated Jan. 26, 2009 from U.S. Appl. No. 11/948,185, filed Nov. 30, 2007 (7 pages).

Office Action dated Aug. 18, 2009 from U.S. Appl. No. 11/948,185, filed Nov. 30, 2007 (8 pages).

(Continued)

*Primary Examiner* — Kaj K Olsen

*Assistant Examiner* — Ross J Christie

(74) *Attorney, Agent, or Firm* — Ballard Spahr LLP

(57) ABSTRACT

In one example, a method for producing a cutting device matrix includes mixing a plurality of constituent matrix materials using a resonant acoustic mixing process until the constituent matrix materials are substantially homogeneously distributed throughout the matrix.

20 Claims, 4 Drawing Sheets

(56) References Cited

U.S. PATENT DOCUMENTS

| | | | | |
|---|---|---|---|---|
| 4,186,628 | A | 2/1980 | Bonnice | |
| 4,189,015 | A | 2/1980 | Acker et al. | |
| 4,190,126 | A | 2/1980 | Kabashima | |
| 4,208,154 | A | 6/1980 | Gundy | |
| 4,211,294 | A | 7/1980 | Multakh | |
| 4,452,325 | A | 6/1984 | Radd et al. | |
| 4,499,959 | A | 2/1985 | Grappendorf et al. | |
| 4,534,773 | A | 8/1985 | Phaal et al. | |
| 4,595,623 | A | 6/1986 | Du Pont et al. | |
| 4,681,174 | A | 7/1987 | Aubakirov et al. | |
| 4,698,070 | A | 10/1987 | Ohno | |
| 4,863,490 | A | 9/1989 | Buljan et al. | |
| 4,960,643 | A | 10/1990 | Lemelson | |
| 5,010,043 | A * | 4/1991 | Ringwood | 501/90 |
| 5,011,514 | A * | 4/1991 | Cho et al. | 51/295 |
| 5,025,871 | A | 6/1991 | Stewart et al. | |
| 5,052,153 | A | 10/1991 | Wiand | |
| 5,069,584 | A | 12/1991 | Obermeier et al. | |
| 5,092,910 | A | 3/1992 | deKok et al. | |
| 5,151,107 | A * | 9/1992 | Cho et al. | 51/295 |
| 5,218,888 | A | 6/1993 | Merrill | |
| 5,248,464 | A | 9/1993 | Alford et al. | |
| 5,370,944 | A | 12/1994 | Omori | |
| 5,435,815 | A | 7/1995 | Ikegaya et al. | |
| 5,451,352 | A | 9/1995 | Cook | |
| 5,628,376 | A | 5/1997 | Kleine | |
| 5,644,956 | A | 7/1997 | Blackman et al. | |
| 5,677,372 | A | 10/1997 | Yamamoto et al. | |
| 5,823,276 | A | 10/1998 | Beck, III | |
| 5,901,964 | A | 5/1999 | Williams et al. | |
| 5,932,508 | A | 8/1999 | Armstrong et al. | |
| 5,996,571 | A | 12/1999 | Jedick | |
| 6,029,544 | A | 2/2000 | Katayama | |
| 6,084,052 | A | 7/2000 | Aufdermarsh et al. | |
| 6,129,077 | A | 10/2000 | Parini | |
| 6,273,924 | B1 | 8/2001 | Krenkel et al. | |
| 6,390,890 | B1 | 5/2002 | Molnar | |
| 6,399,737 | B1 | 6/2002 | Elkovitch | |
| 6,413,287 | B1 | 7/2002 | Barber, Jr. | |
| D466,139 | S | 11/2002 | Kim et al. | |
| 6,524,363 | B2 | 2/2003 | Gates, Jr. | |
| 6,595,844 | B1 | 7/2003 | Mizuno et al. | |
| 6,607,835 | B2 | 8/2003 | Fang et al. | |
| 6,783,616 | B1 | 8/2004 | Krone | |
| 6,997,977 | B2 | 2/2006 | Dallas et al. | |
| 7,141,086 | B2 | 11/2006 | Endoh et al. | |
| 7,188,993 | B1 * | 3/2007 | Howe et al. | 366/111 |
| 7,243,745 | B2 | 7/2007 | Skeem et al. | |
| 7,306,828 | B2 * | 12/2007 | Barrera et al. | 427/427 |
| 7,628,228 | B2 | 12/2009 | Drivdahl | |
| 7,641,004 | B2 | 1/2010 | Lapointe | |
| 7,695,542 | B2 * | 4/2010 | Drivdahl et al. | 75/229 |
| 7,828,090 | B2 | 11/2010 | Drivdahl | |
| 7,866,878 | B2 | 1/2011 | Howe | |
| 7,874,384 | B2 | 1/2011 | Drivdahl | |
| 7,909,119 | B2 | 3/2011 | Drivdahl | |
| 7,918,288 | B2 | 4/2011 | Drivdahl | |
| 7,958,954 | B2 | 6/2011 | Drivdahl et al. | |
| 8,141,656 | B1 | 3/2012 | Bertagnolli | |
| 2002/0020564 | A1 | 2/2002 | Fang et al. | |
| 2003/0162648 | A1 | 8/2003 | Middlemiss | |
| 2004/0023145 | A1 | 2/2004 | Moussa et al. | |
| 2004/0029706 | A1 * | 2/2004 | Barrera et al. | 501/99 |
| 2004/0094026 | A1 | 5/2004 | Efim et al. | |
| 2005/0016775 | A1 | 1/2005 | Hiranuma et al. | |
| 2005/0115743 | A1 | 6/2005 | Griffo | |
| 2005/0189647 | A1 | 9/2005 | Sung | |
| 2005/0247491 | A1 | 11/2005 | Mirchandani et al. | |
| 2006/0243494 | A1 | 11/2006 | Koltermann et al. | |
| 2007/0051455 | A1 | 3/2007 | Franchet et al. | |
| 2007/0104399 | A1 | 5/2007 | Hamza | |
| 2007/0131456 | A1 | 6/2007 | Lapointe | |
| 2007/0228317 | A1 * | 10/2007 | Barrera et al. | 252/62 |
| 2007/0246266 | A1 | 10/2007 | Larbo | |
| 2008/0066969 | A1 | 3/2008 | Paul-Philippe | |
| 2008/0128170 | A1 * | 6/2008 | Drivdahl et al. | 175/58 |
| 2008/0142262 | A1 | 6/2008 | Drivdahl et al. | |
| 2008/0209818 | A1 | 9/2008 | Belnap et al. | |
| 2008/0223621 | A1 | 9/2008 | Middlemiss et al. | |
| 2009/0071724 | A1 * | 3/2009 | Drivdahl et al. | 175/403 |
| 2009/0078469 | A1 * | 3/2009 | Drivdahl et al. | 175/374 |
| 2010/0006344 | A1 | 1/2010 | Drivdahl et al. | |
| 2010/0008738 | A1 * | 1/2010 | Drivdahl et al. | 408/199 |
| 2010/0012385 | A1 | 1/2010 | Drivdahl et al. | |
| 2010/0012386 | A1 | 1/2010 | Drivdahl | |
| 2010/0294113 | A1 | 11/2010 | Mcpherson | |
| 2010/0320005 | A1 | 12/2010 | Burhan | |
| 2011/0031027 | A1 | 2/2011 | Drivdahl | |
| 2011/0036640 | A1 | 2/2011 | Lambert | |
| 2011/0067924 | A1 | 3/2011 | Lambert | |
| 2012/0228036 | A1 | 9/2012 | Drivdahl | |

FOREIGN PATENT DOCUMENTS

| | | | |
|---|---|---|---|
| EP | 0503822 | | 9/1992 |
| JP | 03-243735 | | 10/1991 |
| JP | 2004358580 | A | 12/2004 |
| JP | 2006255822 | A | 9/2006 |
| RU | 2162365 | | 1/2001 |
| WO | 0192677 | A1 | 12/2001 |
| WO | 2006076795 | A1 | 7/2006 |
| WO | WO 2012/036849 | | 3/2012 |

OTHER PUBLICATIONS

Office Action dated Oct. 5, 2009 from U.S. Appl. No. 11/948,185, filed Nov. 30, 2007 (7 pages).

Notice of Allowance dated Feb. 12, 2010 from U.S. Appl. No. 11/948,185, filed Nov. 30, 2007 (8 pages).

Issue Notification dated Mar. 24, 2010 from U.S. Appl. No. 11/948,185, filed Nov. 30, 2007 (1 page).

Office Action dated Aug. 3, 2009 from U.S. Appl. No. 12/276,903, filed Nov. 24, 2008 (9 pages).

Office Action dated Sep. 24, 2009 from U.S. Appl. No. 12/276,903, filed Nov. 24, 2008 (9 pages).

Office Action dated Jan. 19, 2010 from U.S. Appl. No. 12/276,903, filed Nov. 24, 2008 (9 pages).

Office Action dated Apr. 27, 2010 from U.S. Appl. No. 12/276,903, filed Nov. 24, 2008 (12 pages).

Office Action dated Nov. 14, 2011 from U.S. Appl. No. 12/276,903, filed Nov. 24, 2008 (9 pages).

Office Action dated May 21, 2009 from U.S. Appl. No. 12/276,870, filed Nov. 24, 2008 (11 pages).

Office Action dated Nov. 27, 2009 from U.S. Appl. No. 12/276,870, filed Nov. 24, 2008 (9 pages).

Office Action dated May 12, 2010 from U.S. Appl. No. 12/276,870, filed Nov. 24, 2008 (7 pages).

Office Action dated Oct. 19, 2010 from U.S. Appl. No. 12/276,870, filed Nov. 24, 2008 (8 pages).

Notice of Allowance dated Mar. 7, 2011 from U.S. Appl. No. 12/276,870, filed Nov. 24, 2008 (9 pages).

Issue Notification dated Jun. 22, 2011 from U.S. Appl. No. 12/276,870, filed Nov. 24, 2008 (1 page).

Office Action dated Nov. 14, 2011 from U.S. Appl. No. 12/561,936, filed Sep. 17, 2009 (10 pages).

Notice of Allowance dated Jan. 10, 2012 from U.S. Appl. No. 12/561,936, filed Sep. 17, 2009 (7 pages).

International Search Report dated Aug. 5, 2008 from International Patent Application No. PCT/US2007/086156 filed Nov. 30, 2007 (1 page).

International Preliminary Report on Patentability dated Jun. 3, 2009 from International Patent Application No. PCT/US2007/086156 filed Nov. 30, 2007 (11 page).

International Search Report and Written Opinion dated May 9, 2011 from International Patent Application No. PCT/US2010/049742 filed Sep. 22, 2010 (7 pages).

International Search Report and Written Opinion for International Application No. PCT/US2011/058042 (mailed Jun. 8, 2012).

* cited by examiner

USE OF RESONANT MIXING TO PRODUCE IMPREGNATED BITS

RELATED APPLICATIONS

This application hereby claims priority to U.S. Provisional Patent Application Ser. No. 61/476,027, entitled USE OF RESONANT MIXING TO PRODUCE IMPREGNATED BITS, filed Apr. 15, 2011, and incorporated herein in its entirety by this reference.

FIELD OF THE INVENTION

This application relates generally to devices for use in processes such as drilling and cutting for example, and to methods of making and using such devices. In particular, embodiments within the scope of the invention include devices, such as drill bits for example, that include a cutting portion having a relatively homogeneous matrix that includes a plurality of disparate constituent elements. Yet other embodiments within the scope of the invention include methods and processes for making such devices.

BRIEF SUMMARY OF SOME EXAMPLE EMBODIMENTS

In one example embodiment of a method within the scope of the invention, the following processes are used: perform dry mix of high density material, such as tungsten powder for example, and low density high aspect ratio material, such as fiber for example, in a shear mixing process; add oil to dry mix and use shear mixing to distribute oil; add diamonds to mixed powder; and, mix diamonds and powder using resonant acoustic mixing process.

In another example embodiment, a matrix comprises a plurality of materials that are, or have been, mixed together using a resonant acoustic mixing process. Such a process may result in a substantially homogeneous distribution of the various constituent materials throughout the matrix. By way of example, and not limitation, the matrix may be used as at least a portion of a drill bit or any other cutting or boring device.

In another example embodiment, a matrix may comprise low-density high-dimension materials combined with high-density materials, where the two types of materials are distributed substantially homogeneously throughout the matrix. By way of example, and not limitation, the matrix may be used as at least a portion of a drill bit or any other cutting or boring device.

In a further embodiment, a matrix may comprise low-density high-dimension materials that are combined with high-density materials using a resonant acoustic mixing process. By way of example, and not limitation, the matrix may be used as at least a portion of a drill bit or any other cutting or boring device.

In other example embodiments, any of the aforementioned matrix examples may include one or more of long low-density fibers, high density powder, and low-density large surface area. In a refinement of this example embodiment, the high density powder comprises powder tungsten, and the low-density large surface area material comprises diamond.

In another embodiment, a resonant acoustic mixing process may be used to substantially homogenously distribute a variety of disparate materials throughout a matrix. By way of example, and not limitation, the matrix produced by such a process may be used as at least a portion of a drill bit or any other cutting or boring device.

In a further embodiment, a mixing process may be used to substantially homogenously distribute a variety of disparate materials throughout a matrix, and the mixing process may include one or more resonant acoustic mixing processes combined with one or more of shear mixing process and three axis gravity mixing process.

In still further embodiments, a mixing process may be used to substantially homogenously distribute a variety of disparate materials throughout a matrix, and the mixing process may include one or more resonant acoustic mixing processes combined with one or both of a shear mixing process and a three axis gravity mixing process, where the resonant acoustic mixing, and one or both of the shear mixing and three axis gravity mixing may be performed in any order.

In a further embodiment, a core drill bit, or other drill bit or cutting device, may include the matrix of any of the aforementioned examples.

In yet another embodiment, a drilling or cutting process may employ a drilling or cutting element comprising the matrix according to any of the aforementioned embodiments.

In another example embodiment, a drill string may be provided that includes a drill bit comprising the matrix according to any of the aforementioned embodiments.

In a further embodiment, a drill rig may be provided that includes the aforementioned drill string, a drill head, and a mast to which the drill head is coupled.

Yet other example embodiments are set forth in the claims appended hereto and/or are disclosed elsewhere herein.

It should be noted that the embodiments disclosed herein do not constitute an exhaustive summary of all possible embodiments, nor does the following discussion constitute an exhaustive list of all aspects of any particular embodiment(s). Rather, the following discussion simply presents selected aspects of some example embodiments. It should be noted that nothing herein should be construed as constituting an essential or indispensable element of any invention or embodiment. Rather, and as the person of ordinary skill in the art will readily appreciate, various aspects of the disclosed embodiments may be combined in a variety of ways so as to define yet further embodiments. Such further embodiments are considered as being within the scope of this disclosure. As well, none of the embodiments embraced within the scope of this disclosure should be construed as resolving, or being limited to the resolution of, any particular problem(s). Nor should such embodiments be construed to implement, or be limited to implementation of, any particular effect(s).

Finally, the scope of the invention is not limited to drill bits, nor to any particular type or configuration of drill bit. More generally, the invention embraces, among other things, any type of cutting or drilling device wherein aspects of this disclosure may be employed. By way of illustration only, the matrix and processes disclosed herein may be employed in connection with the manufacturing and/or use of navi-drills, and full hole drills.

BRIEF DESCRIPTION OF THE DRAWINGS

The appended drawings contain figures of example embodiments to further illustrate and clarify various aspects of the present invention. It will be appreciated that these drawings depict only example embodiments of the invention and are not intended to limit its scope. Aspects of the invention will be described and explained with additional specificity and detail through the use of the accompanying drawings in which.

DETAILED DESCRIPTION OF SOME EXAMPLE EMBODIMENTS

Figure 1:
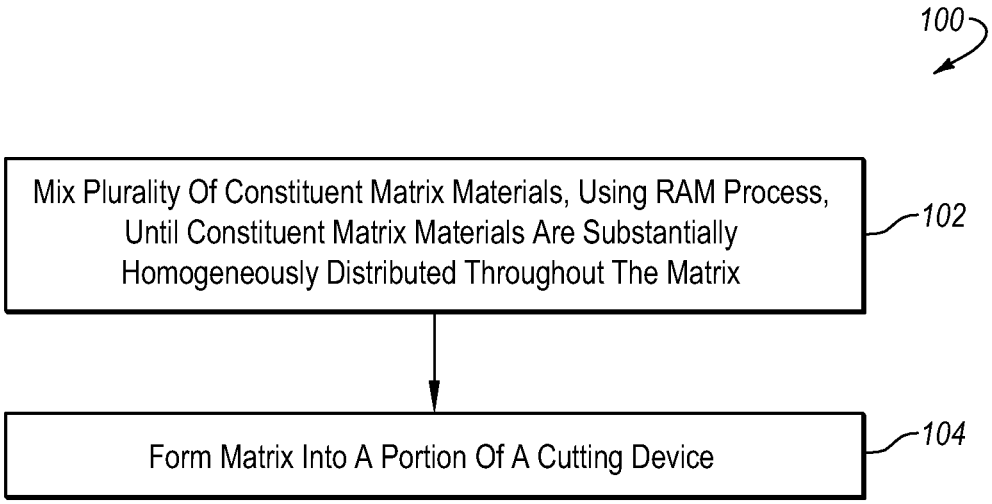
FIG. 1 is a flow chart of an example process for producing at least a portion of a matrix usable as part of a cutting tool.

The following description discloses details concerning aspects of various example embodiments of the invention. In one example embodiment, a matrix comprises a plurality of materials that are, or have been, mixed together at least in part through the use of a resonant acoustic mixing process. Such a process may result in a substantially homogeneous distribution of the various constituent materials throughout the matrix. By way of example, and not limitation, example embodiments of the disclosed matrix may be used in/on, and/or constitute, a cutting portion of a device such as drill bit. Drill bits employing a matrix such as the examples disclosed herein may be referred to as impregnated bits.

Example Materials

In general, a matrix may include a binder material which may include one or more constituents. Distributed throughout the binder material may be one or more other materials. Such other materials may include abrasive materials. The binders and abrasive materials are examples of constituent materials that may be mixed together to form a matrix.

A wide variety of different materials may be employed in connection with the methods and devices disclosed herein. By way of example, one or more of long low-density fibers, high density materials such as powder metals, and low-density large surface area materials may be combined to produce a matrix that makes up at least part of a cutting portion of a device such as a cutting device. As another example, one or more high density materials and one or more low-density large surface area materials may be mixed to produce a matrix.

The properties of the constituent materials used in the matrix may differ greatly from one constituent material to another. By way of illustration, and with reference to the preceding example, the material of the long low-density fibers may have a density that is substantially less than a density of the high density materials. As well, the low-density large surface area materials may have a density that is substantially less than a density of the high density materials. As another example, the long low-density fibers may have a physical structure that is substantially larger in one or more dimensions, such as length for example, than a physical structure of the high density materials and/or the physical structure of the low-density large surface area materials. Similarly, the low-density large surface area materials may have a physical structure that is substantially larger in some aspect, such as surface area, than a physical structure of the long low-density fibers and/or the physical structure of the high density materials. Of course, variables such as density, length, and surface area associated with each constituent element may be varied as desired to suit the requirements of a particular application or operating environment.

Examples of long low-density fibers include carbon fibers, although other material(s) of comparable properties may also be employed. Examples of high density materials include powder metals, such as tungsten. As well, examples of low-density large surface area materials include natural and synthetic diamond, such as polycrystalline diamond compacts for example.

A variety of other materials may also be employed in connection with a resonant acoustic mixing process to produce a matrix that may be employed as at least a portion of a drill bit or other cutting or boring device. Some examples of materials that may be suitable for use as a binder include copper, copper alloys, iron, Ag, Zn, nickel alloys, Ni, Co, Mo, and combinations of the foregoing. Other material(s) having comparable properties may also be employed. The matrix may also include abrasives such as one or more of powder of tungsten carbide, boron nitride, iron, steel, Co, Mo, W, ferrous alloys, W, diamond, Fe, and combinations of the foregoing. However, the scope of the invention is not limited to any particular combination, or combinations, of matrix constituent elements.

Finally, the relative amounts or ratios of materials employed in any given method and/or matrix may be varied as desired, and the scope of the invention is not limited to any particular volume or weight ratios of matrix constituent materials.

Example Mixing Processes

As disclosed elsewhere herein, a matrix for a cutting tool may include a variety of constituent components mixed together. These components may be mixed together by a variety of methods. For example, the components may be mixed solely with a resonant acoustic mixing process, sometimes also referred to by the acronym 'RAM.' Some examples of resonant acoustic mixing processes, and apparatuses, that may be employed are disclosed in U.S. Pat. No. 7,188,993—'APPARATUS AND METHOD FOR RESONANT-VIBRATORY MIXING,' incorporated herein in its entirety by this reference.

It should be noted that a resonant acoustic mixing device is one example implementation of a means for homogeneously mixing matrix constituent components. Any other device, or combination of devices, of comparable functionality may alternatively be employed.

As another example, some or all of the components may be mixed with a resonant acoustic mixing process and also with one or both of a shear mixing process and three axis gravity mixing process. In this latter example, the resonant acoustic mixing process, shear mixing process, and gravity mixing process can be performed in any order. Moreover, some components of a matrix can be mixed with one type of mixing process, while other components of that matrix are mixed using another type of mixing process. The mixes thus produced can then be combined using any of the aforementioned mixing processes. More generally, any other process, or processes, that produce a substantially homogeneous distribution of the constituent components of the matrix may be employed.

In another example embodiment, the matrix may be mixed with a multiple part resonant acoustic mixing process. In one particular example of such a mixing process, two separate resonant acoustic mixing processes are employed. In this example, a first resonant acoustic mixing process is performed to create a first mixture that comprises two or more constituent elements of the matrix. Then, a second resonant acoustic mixing process is performed after substantial completion of the first mixing process. This second resonant acoustic mixing process creates a second mixture that includes both the first mixture and one or more additional constituent elements of the matrix.

Mixing processes such as the examples noted above and elsewhere herein may be advantageous over conventional processes insofar as the disclosed mixing processes may produce a substantially homogeneous distribution of constituent components in a matrix used for a drill bit or other cutting or boring device. More specifically, the disclosed mixing processes may enable substantially homogeneous distribution of a plurality of constituent components in a matrix, even where those constituent components are highly disparate, relative to each other, in terms of properties such as their density, physical dimensions, and physical structure. As well, the resonant acoustic mixing processes disclosed herein may reduce, or substantially eliminate clumping of matrix constituent materials such as low-density large surface area diamonds.

In some instances, devices produced without such a homogeneous distribution can experience up to about an 80 percent reduction in expected life. Thus, use of the processes disclosed herein may result in a substantially extended life for drill bits and other cutting and boring devices. Such an extended life can be particularly advantageous where the matrix disclosed herein is used in conjunction with a drill bit, since a substantial amount of time and work may be involved in tripping a drill string out of a hole to replace the drill bit Likewise, substantial time and work may be involved when tripping the drill string back down the hole after the drill bit has been replaced. And, of course, a longer bit life will likely require the use of fewer drill bits for a given operation, and a cost savings may thus be realized with regard to the drill bits themselves.

Specific Example Mixing Processes of FIGS. 1-4

With reference now to the Figures, aspects of various further examples of methods for producing at least a portion of a cutting device matrix are disclosed. In general, the various acts that are recited in each method may be performed in whatever order is desirable and the acts need not necessarily be performed in the order presented in the Figures, nor is it necessary that all acts of each method be performed. Moreover, the person of ordinary skill in the art will understand that any or all of the methods of FIGS. 1-4 may be supplemented with yet further acts, that one or more acts of the methods of any of FIGS. 1-4 may be replaced with one or more other acts, and that one or more acts of any of the methods may be omitted.

With particular attention now to FIG. 1, an example method 100 is disclosed. At 102, a plurality of constituent matrix materials are mixed using a resonant acoustic mixing process until the constituent matrix materials are substantially homogeneously distributed throughout the matrix. At 104, which may be omitted from the method 100 if desired, the matrix performed at 102 is formed into a portion of a cutting device. As suggested above, variations and refinements to the method 100 may be employed. For example, a further act may be performed as part of method 100, in which one or both of a shear mixing process and a three axis gravity mixing process are employed to mix the constituent matrix materials. As another example, the plurality of constituent matrix materials may comprise one or more of long low-density fibers, a high density powder, and a low-density large surface area material. As a further example, the plurality of constituent matrix materials may comprise a first material having a first density and a second material having a second density that is substantially greater than the first density. One or more of the aforementioned variations and refinements may be combined to define still further embodiments of a method for producing at least a portion of a cutting device matrix.

Figure 2:
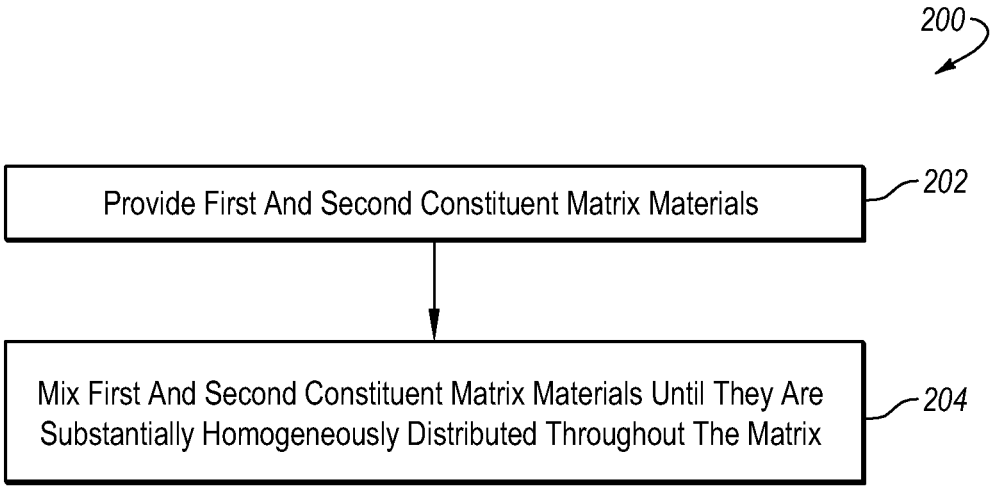
FIG. 2 is a flow chart of an example process for producing at least a portion of a matrix usable as part of a cutting tool.

With particular attention now to FIG. 2, an example method 200 is disclosed. At 202, first and second constituent matrix materials are provided. In one particular example, the first constituent matrix material comprises a low-density, high-dimension material, and/or the second constituent matrix material comprises a high density material. At 204, the first and second constituent matrix materials are mixed until the constituent matrix materials are substantially homogeneously distributed throughout the matrix. As suggested above, variations and refinements to the method 200 may be employed. For example, the low-density, high-dimension material may comprise carbon fibers, and/or the high density material may comprise tungsten. As another example, a further act may be performed as part of the method 200, in which a third constituent matrix material is mixed to form a part of the matrix, and comprises a low-density, large surface area material. As a further example, the low-density large surface area material may comprise diamond. In another example, the mixing process comprises a resonant acoustic mixing process. In a final example, a further act may be performed as part of the method 200, in which the matrix is formed into at least a portion of a cutting device. One or more of the aforementioned variations and refinements may be combined to define still further embodiments of a method for producing at least a portion of a cutting device matrix.

Figure 3:
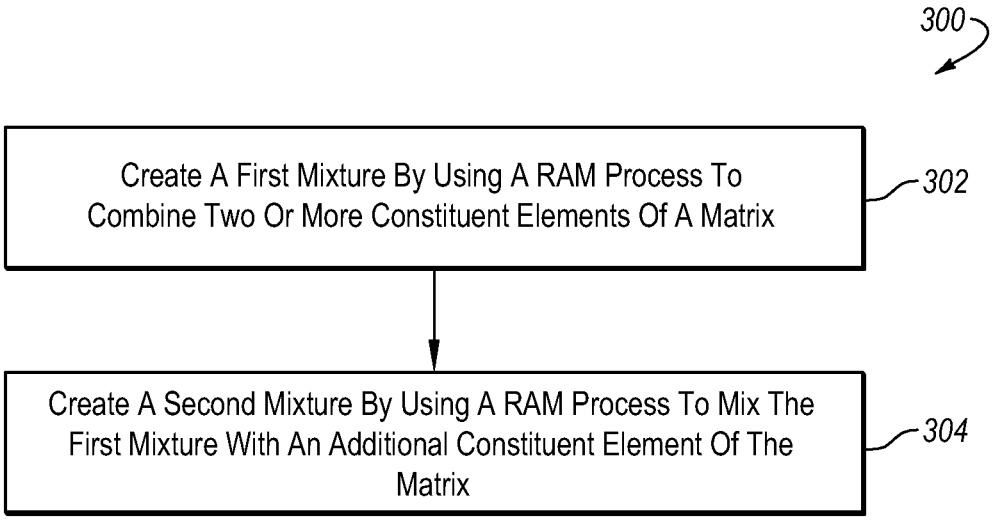
FIG. 3 is a flow chart of an example process for producing at least a portion of a matrix usable as part of a cutting tool.

With particular attention now to FIG. 3, an example method 300 is disclosed. At 302, a first mixture of two or more constituent elements of a matrix is created by using a resonant acoustic mixing process to combine those constituent elements of the matrix. At 304, a second mixture is created that includes the first mixture and an additional constituent element of the matrix. The second mixture is produced using a resonant acoustic mixing process. As suggested above, variations and refinements to the method 300 may be employed. For example, the two or more constituent elements may comprise one or both of carbon fibers and oil. In another example, the additional constituent element of the matrix may comprise diamonds. In a further example, only diamonds are added during the second mixing process. In yet another example, performing the first mixing process comprises performing the first mixing process until the two or more constituent elements are substantially homogeneously distributed throughout the first mixture. In a final example, performing the second mixing process comprises performing the second mixing process until the two or more constituent elements and the additional constituent element are substantially homogeneously distributed throughout the second mixture. One or more of the aforementioned variations and refinements may be combined to define still further embodiments of a method for producing at least a portion of a cutting device matrix.

Figure 4:
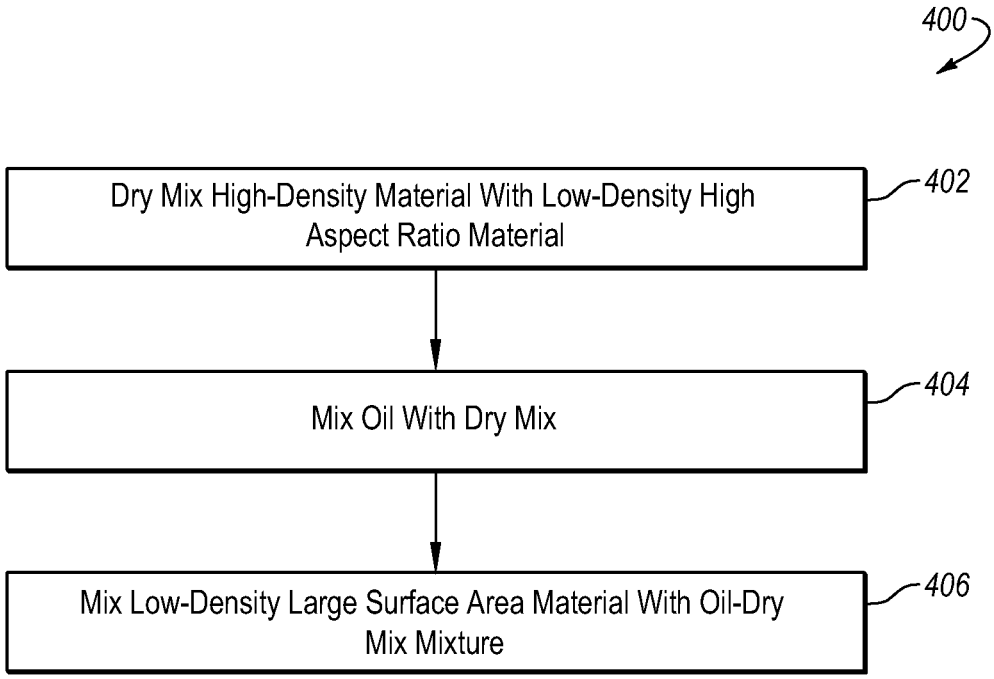
FIG. 4 is a flow chart of an example process for producing at least a portion of a matrix usable as part of a cutting tool.

With particular attention, finally, to FIG. 4, an example method 400 is disclosed. At 402, a high-density material is dry mixed with a low-density high aspect ratio material. The high aspect ratio material may also be referred to herein as a high dimension material. At 404, oil is mixed with the dry mix produced at 402. And, at 406, low-density large surface area material is mixed with the mix produced at 404.

In one particular implementation of the method 400, the dry mix process of 402 comprises a shear mixing process, and the high-density material of the dry mix produced at 402 comprises tungsten powder, while the low-density high aspect ratio material of the dry mix produced at 402 comprises fiber. In this same particular implementation, the mixing process of 404 comprises a shear mixing process. Finally, in this same implementation, at 406, the low-density large surface area material comprises diamonds, and the mixing process of 406 comprises a resonant acoustic mixing process.

It will be appreciated that, as with other example methods disclosed herein, one or more variations may be made to the method 400. By way of illustration, another example method may include mixing a powder metal and fiber to form a first mixture, adding oil to the first mixture, using a shear mixing process to distribute the oil in the first mixture, adding an abrasive to the mixture of the oil and the first mixture, and mixing the abrasive, oil, and first mixture using resonant acoustic mixing. This example method may be further refined by using a dry mix process to mix the powder metal and fiber. Another refinement may include wet mixing the oil and the first mixture. Finally, the powder metal may comprise tungsten and/or other metals, and the abrasive may comprise diamond. One or more of the aforementioned variations and refinements may be combined to define still further embodiments of a method for producing at least a portion of a cutting device matrix.

In another example variation of the method 400, a method may include wet mixing a powder metal and oil to form a first mixture, using a shear mixing process to mix fiber with the first mixture, adding an abrasive to the mixture of the fiber and the first mixture, and mixing the abrasive, oil, and first mixture using resonant acoustic mixing. In this example, the abrasive may comprise diamond and/or the powder metal may comprise tungsten and/or other metals.

Example Cutting Devices

The matrix embodiments disclosed herein can be used in any device that is intended to cut through one or more materials. Such devices may be referred to herein as cutting devices, and any cutting device produced by any method disclosed herein, or by any method derived from this disclosure, is considered to be within the scope of the invention. Thus, the matrix can be employed in cutting devices such as drill bits and saw blades. Some examples of drill bits include those used in mining and exploration operations, such as core drill bits. Examples of other drill bits that may employ various embodiments of the matrix disclosed herein include the drill bits disclosed and/or claimed in U.S. Pat. No. 7,628,228, U.S. Pat. No. 7,918,288, US Pub. 2011/0031027, U.S. Pat. No. 7,828,090, US Pub. 2010/0012386, U.S. Pat. No. 7,874,384, U.S. Pat. No. 7,909,119, U.S. Pat. No. 7,695,542, US Pub. 2009/0078469, US Pub. 2009/0071724, US Pub. 2010/0008738, US Pub. 2011/0036640, and US Pub. 2011/0067924, each of which is incorporated herein by this reference in its respective entirety.

The present invention may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed is:

1. A method for producing a cutting device matrix, comprising:

mixing a plurality of constituent matrix materials using a resonant acoustic mixing process until the constituent matrix materials are substantially homogeneously distributed throughout the matrix; and performing at least one of a shear mixing process and a three axis gravity mixing process on the constituent matrix materials.

2. The method of claim 1, wherein the plurality of constituent matrix materials comprises at least one of carbon fiber, tungsten, and diamond.

3. The method of claim 1, further comprising forming the matrix into at least a portion of a cutting device.

4. The method of claim 1, wherein the step of performing at least one of a shear mixing process and a three axis gravity mixing process on the constituent matrix materials comprises performing a shear mixing process and a three axis gravity mixing process on the constituent matrix materials.

5. The method of claim 1, wherein the plurality of constituent matrix materials comprises at least one of long low-density fibers, a high density powder, and a low-density large surface area material.

6. The method of claim 1, wherein the plurality of constituent matrix materials comprises a first material having a first density and a second material having a second density that is substantially greater than the first density.

7. A cutting device comprising the cutting device matrix produced by the method of claim 1.

8. A method for producing a cutting device matrix, comprising: providing first and second constituent matrix materials, wherein the first constituent matrix material comprises a low-density, high-dimension material, and the second constituent matrix material comprises a high density material;

mixing the first and second constituent matrix materials in a resonant acoustic mixing process until the constituent matrix materials are substantially homogeneously distributed throughout the matrix; and performing at least one of a shear mixing process and a three axis gravity mixing process on the first and second constituent matrix materials.

9. The method as recited in claim 8, wherein the low-density, high-dimension material comprises carbon fibers, and the high density material comprises tungsten.

10. The method as recited in claim 8, further comprising providing a third constituent matrix material that comprises a low-density, large surface area material, and mixing the third constituent matrix material with the first and second constituent matrix materials.

11. The method as recited in claim 10, wherein the low-density large surface area material comprises diamond.

12. The method of claim 8, further comprising forming the matrix into at least a portion of a cutting device.

13. A cutting device comprising the cutting device matrix produced by the method of claim 8.

14. The method of claim 6, wherein the first material is a low-density, high-dimension material, and wherein the second material is a high density material.

15. The method of claim 14, wherein the first material comprises carbon fibers, and wherein the second material comprises tungsten.

16. A method for producing a cutting device matrix, comprising: providing first and second constituent matrix materials, wherein the first constituent matrix material comprises low-density, high-dimension carbon fibers, and wherein the second constituent matrix material comprises high density tungsten;

mixing the first and second constituent matrix materials in a resonant acoustic mixing process until the constituent matrix materials are substantially homogeneously distributed throughout the matrix; and performing at least one of a shear mixing process and a three axis gravity mixing process on the first and second constituent matrix materials.

17. The method as recited in claim 16, further comprising:

providing a third constituent matrix material that comprises a low-density, large surface area material; and mixing the third constituent matrix material with the first and second constituent matrix materials.

18. The method as recited in claim 17, wherein the low-density large surface area material comprises diamond.

19. The method of claim 16, further comprising forming the matrix into at least a portion of a cutting device.

20. A cutting device comprising the cutting device matrix produced by the method of claim 16.

* * * * *